United States Patent [19]

Biby

[11] Patent Number: 4,670,760

[45] Date of Patent: Jun. 2, 1987

[54] ANTENNA APPARATUS AND METHOD FOR CURTAILING SKY WAVES

[76] Inventor: Richard L. Biby, 4900 N. 16th St., Arlington, Va. 22205

[21] Appl. No.: 768,661

[22] Filed: Aug. 23, 1985

[51] Int. Cl.[4] ..... H01Q 1/48; H01Q 9/36

[52] U.S. Cl. ..... 343/832; 343/846; 343/874

[58] Field of Search ..... 343/725, 729, 832, 841, 343/845, 846, 847, 874

[56] References Cited

U.S. PATENT DOCUMENTS

| | | | |
|---|---|---|---|
| 1,683,739 | 9/1928 | Stone | 343/727 |
| 2,064,204 | 12/1936 | Gothe et al. | 343/727 |
| 2,283,617 | 5/1942 | Wilmotte | 343/725 |
| 2,283,618 | 5/1942 | Wilmotte | 343/725 |
| 2,516,706 | 7/1950 | Laport | 343/727 |
| 2,609,504 | 9/1952 | Wilmotte | 343/727 |
| 2,770,802 | 11/1956 | Mullaney | 248/301 |
| 3,742,511 | 6/1973 | Smith et al. | 343/847 |

OTHER PUBLICATIONS

R. C. Fenwick, "A New Class of Electrically Small Antennas", *IEE Transactions on Antennas and Propagation*, May 1965, pp. 379–383.

*Radio Engineers' Handbook*, pp. 816–818.

*Primary Examiner*—Eli Lieberman

*Attorney, Agent, or Firm*—Griffin, Branigan and Butler

[57] ABSTRACT

A radiating antenna system (30) comprises a plurality of vertically erect secondary antennae (34) disposed in a pattern about a vertically erect primary antenna (32). An electrically conductive screen (36) which surrounds the pattern of secondary antennae (34) includes partially-buried, partially exposed electrical conductors (54) which have exposed ends (**54*b*) thereof electrically connected to one or more above-ground, loop-forming cables (52). A series of open-ended transmission lines 70 are suspended in an essentially horizontal plane above the ground with each of the transmission lines (70) being electrically connected to a top of an associated secondary antenna (34). The secondary antennae (34) are excited in a manner whereby radiation therefrom essentially cancels sky waves radiated by the primary antenna (32). The screen (36) has an electromagnetic image induced thereon and serves to curtail at least the propagation of surface waves radiated by the secondary antennae (34) without significantly curtailing the propagation of surface waves radiated by the primary antenna (32**).

15 Claims, 9 Drawing Figures

ANTENNA APPARATUS AND METHOD FOR CURTAILING SKY WAVES

BACKGROUND

I. Field of the Invention

This invention relates to broadcasting methods and broadcasting antenna systems including method and systems of the type utilized in commercial AM broadcast operations.

II. Prior Art and Other Considerations

A variety of communications services which depend upon the propagation of a "ground wave" or "surface wave" along the earth's surface suffer severe interference problems due to the reflection of signals on their own or related frequencies from ionized layers in the earth's upper atmosphere (the ionosphere). These reflected waves are commonly called "sky waves". Among the services suffering from such interference problems are commercial AM broadcast operations, certain types of navigational aids (LORAN, etc.) and 27 MHz. Citizens band communications.

In general, the interfering signals can originate in either the same radiating system as that which generates the desired "ground wave", or from other facilities using the same or related channels (frequencies), located perhaps many hundreds of miles away. In the former case, the interfering signal, being of the same frequency as the desired signal, and bearing the same modulation, can cause severe variations of amplitude and phase of the received signal. This interference, generally known as "selective fading", can seriously limit the usefulness of a facility.

In the latter case, interference commonly termed "co-channel" interference is caused by sources other than the source of the desired "ground wave". Because the interfering signals in this case bear modulation different than that of the desired signal, their disruptive effect can be even more pronounced than the selective fading-type of interference.

Both the selective fading and co-channel types of interference could be reduced if a means were found to reduce that portion of the energy radiated by an antenna which travels outwardly and upwardly to strike the ionosphere, while at the same time permitting the antenna to launch the desired surface wave efficiently. There have been numerous attempts to design such an antenna. Such efforts have generally depended upon achieving some specific distribution of current and phase on a vertical conductor in order to shape the radiation pattern in the vertical plane (that is, to "squeeze" the radiated signal pattern down as close as possible to the horizontal plane).

In the above regard, U.S. Pat. No. 2,064,204 discloses a broadcast antenna comprising a plurality of separate radiating elements inclined with respect to the vertical and lying in a surface of revolution. U.S. Pat. No. 1,683,739 attempts to set up an antenna array which will confine the electromagnetic waves to a comparatively thin layer adjacent to the surface of the earth by superimposing oscillators in a manner to constitute a linear array of sources which are directive in a vertical plane. The *Radio Engineer's Handbook* describes a system wherein directivity in a vertical plane is combined with a circular pattern in the horizontal plane by arranging short vertical radiators in concentric rings and providing a uniform progressive phase shift between adjacent antennas in the individual rings. Other patents which concern directivity include U.S. Pat. Nos. 2,283,617; 2,283,618; and 2,283,619 to Wilmotte. Another structure which generates strong ground waves while attempting to suppress sky-ward radiation over a limited range of vertical angles is known as the Franklin antenna.

While prior art antenna structures such as the examples given above have been effective at least to a limited extent in curtailing the generation of sky waves radiated in the vertical plane at angles of greater than 45 degrees with respect to the horizontal, prior art structure has not effectively dealt with sky waves radiated in a range of from about 5 degrees or less to 45 degrees with respect to the horizontal. Sky-ward radiation directed in this range of from about 5 degrees to 45 degrees with respect to the horizontal constitutes some of the most bothersome interference.

In view of the foregoing, it is an object of the present invention to provide an antenna structure and broadcasting method wherein sky wave radiation is curtailed through a wide range of vertical angles.

An advantage of the present invention is the provision of an antenna structure which is relatively inexpensive to build and maintain.

A further advantage of the present invention is the provision of method and apparatus which reduces sky wave interference to ground wave signals on the same or related frequencies.

Yet another advantage of the present invention is the provision of method and apparatus wherein the strength of ground wave signals per unit of applied power is increased as compared to currently employed systems.

SUMMARY

A radiating antenna system comprises a plurality of vertically erect secondary antennae disposed in a pattern about a vertically erect primary antenna. An electrically conductive screen which surrounds the pattern of secondary antennae includes partially-buried, partially exposed electrical conductors which have exposed ends thereof electrically connected to one or more above-ground loop-forming cables. A series of open-ended transmission lines are suspended in an essentially horizontal plane above the ground with each of the transmission lines being electrically connected to a top of an associated secondary antenna. The secondary antennae are excited in a manner whereby radiation therefrom essentially cancels sky waves radiated by the primary antenna. The screen has an electromagnetic image induced thereon and serves to curtail at least the propagation of surface waves radiated by the secondary antennae without significantly curtailing the propagation of surface waves radiated by the primary antenna.

BRIEF DESCRIPTION OF THE DRAWINGS

The foregoing and other objects, features, and advantages of the invention will be apparent from the following more particular description of preferred embodiments as illustrated in the accompanying drawings in which reference characters refer to the same parts throughout the various views. The drawings are not necessarily to scale, emphasis instead being placed upon illustrating the principles of the invention.

DETAILED DESCRIPTION OF THE DRAWINGS

If a vertical current-carrying conductor is located near the surface of the earth, an imperfectly conducting dielectric material, as is the case with typical AM broadcast antenna, two distinct far-field waves are generated. One, the "sky-ward wave", is of the form:

EQUATION 1

$$E_{SPACE} = j30\beta Idl\cos\phi\left(\frac{e^{-j\beta R1}}{R_1} + \frac{R_v e^{-j\beta R2}}{R_2}\right)$$

Figure 1:
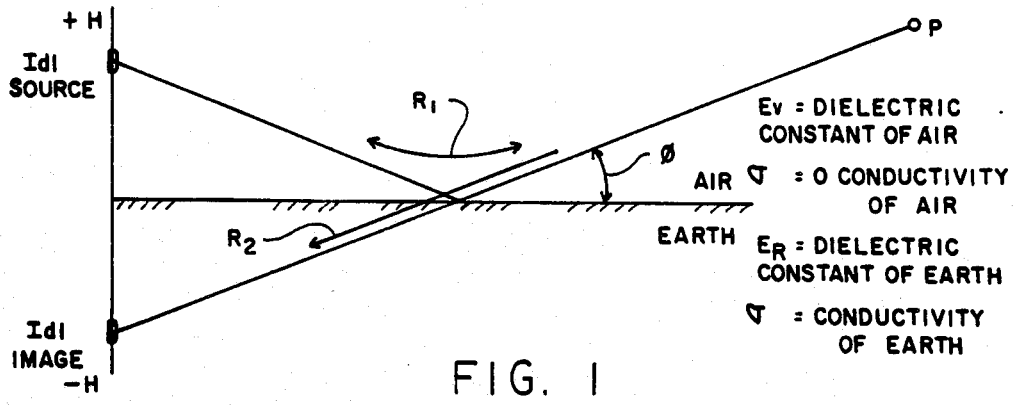
FIG. 1 is a schematic diagram showing geometric parameters associated with the generation of a surface wave and a sky wave by a vertical current carrying conductor above the earth.

The other, the "surface wave" (or "ground wave") has the form:

EQUATION 2

$$E_{SURACE} = j30\beta Idl(1 - R_v)(F)\left(\frac{e^{-j\beta R2}}{R_2}\right) \times \sqrt{1 - 2\mu^2 + (\cos^2\phi)(\mu^2)\left(1 + \sin^2\frac{\phi}{2}\right)^2}$$

Where geometry is as shown in FIG. 1 and where:

EQUATION 3

$$\mu^2 = \frac{1}{(\epsilon_R + jX)}$$

EQUATION 4

$$X = \frac{(1.8 \times 10^4)\tau_R}{f}$$

EQUATION 5

$$R_v = \frac{(\epsilon_R - jX)\sin\phi - \sqrt{(\epsilon_R - jX) - \cos^2\phi}}{(\epsilon_R - jX)\sin\phi + \sqrt{(\epsilon_R - jX) - \cos^2\phi}}$$

($R_v$ being the reflection factor for vertical polarization)

wherein $\tau_r$ is the conductivity of the earth in mhos/meter;

$\epsilon_r = \epsilon/\epsilon_v$ = the relative dielectric constant of the earth; and $f$ = frequency (megahertz)

EQUATION 6

$$\beta = \frac{2\pi}{\lambda} \text{ wherein } \lambda = \text{wavelength (meters)}$$

EQUATION 7

$$F = \{1 + j\sqrt{\pi\omega e^{-\omega}}\,[erfc(-j\sqrt{\omega})]\}$$

EQUATION 8

$$\omega = \frac{j\beta R\mu^2(1 - \mu^2\cos^2\phi)}{2}\left[1 + \frac{\sin\phi}{\mu\sqrt{1 - \mu^2\cos^2\phi}}\right]$$

EQUATION 9

$$erfc(-j\sqrt{\omega}) = \frac{2}{\sqrt{\pi}}\int_{j\sqrt{\omega}}^{\infty} e^{-\nu^2}d\nu$$

Figure 2:
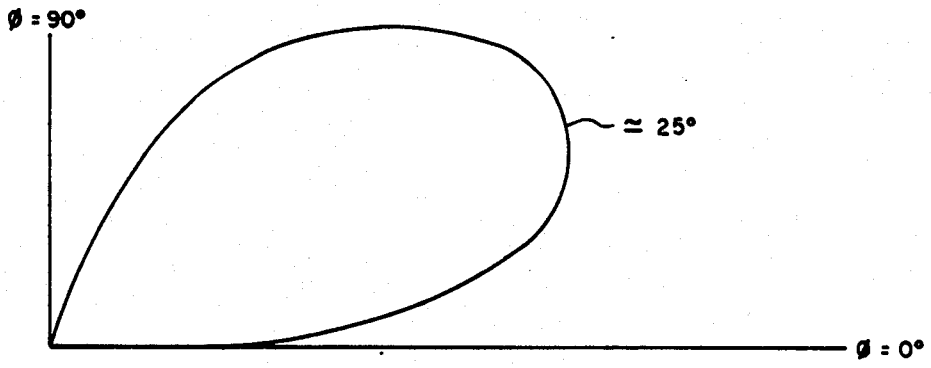
FIG. 2 is a graph showing the relative magnitude of a sky wave field as a function of a vertical angle phi as generated by prior art antenna systems.

The "sky-ward" field has a relative magnitude as a function of the vertical angle phi as shown in FIG. 2. The magnitude of this field is zero at both the zenith (phi=90°) and at the horizontal plane (phi=0°). The zero at the zenith follows from the direction of current flow in the conductor and from the geometry. The zero at the horizontal plane is due to the fact that the two terms in EQUATION 1 which describe the contribution from the source, namely the term $$\left(\frac{e^{-j\beta R1}}{R_1}\right)$$

and the contribution from the source image, namely the term $$\left(\frac{R_v e^{-j\beta R2}}{R_2}\right)$$

are equal in magnitude. However, the vertical coefficient of reflection, RV, has a unique value of −1.0 at the horizontal plane. Thus, complete cancellation of these two terms occurs at phi=0°.

Figure 3A:
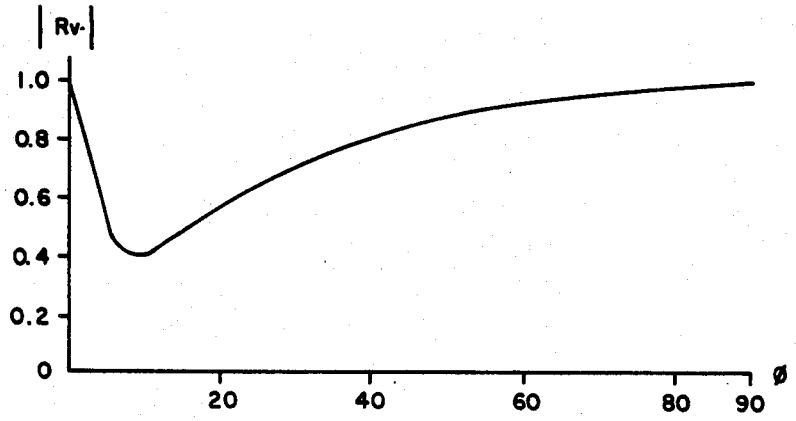
FIG. 3A is a graph showing the magnitude of the absolute value of the vertical coefficient of reflection RV as a function of a vertical angle phi for typical earth material.
Figure 3B:
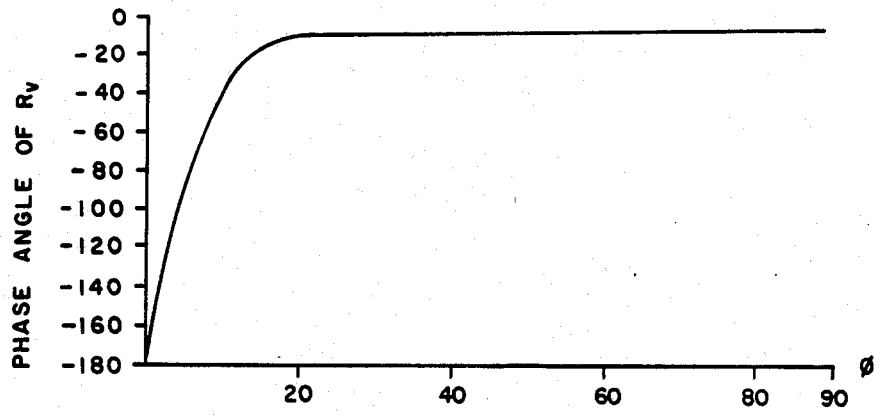
FIG. 3B is a graph showing the magnitude of the phase angle of the vertical coefficient of reflection as a function of vertical angle phi for typical earth material.

The vertical coefficient of reflection varies rapidly in magnitude and phase, as a function of the vertical angle phi. A graph plotting the magnitude of the vertical coefficient of reflection RV vs. the vertical angle phi for typical earth material is shown in FIG. 3A while a graph plotting the phase of the vertical coefficient of reflection vs. the vertical angle phi for typical earth material is shown in FIG. 3B. The maximum magnitude in the sky-ward field pattern generally falls around 25 to 30 degrees above the horizontal. This sky-ward energy is, of course, that which travels outward and upward and, upon reflection from the ionosphere, returns to earth to possibly create interference.

The surface wave, on the other hand, appears to result only from the image, not from the source itself. In this regard, there is no term dependent upon $R_1$ in the surface wave equation—Equation 2).

The term $(1-R_v)$ has the unique value of 2.0 at the horizontal plane, because (as discussed above) the vertical coefficient of reflection has the unique value of −1.0 at the angle phi=0. Because of the manner in which the vertical coefficient of reflection RV varies with the vertical angle phi and the behavior of the surface wave attenuation term F, the surface wave field decreases rapidly with height above the surface, and in no practical case is it a source of ionosphere-reflected interfering signals at standard broadcast frequencies.

Figure 5:
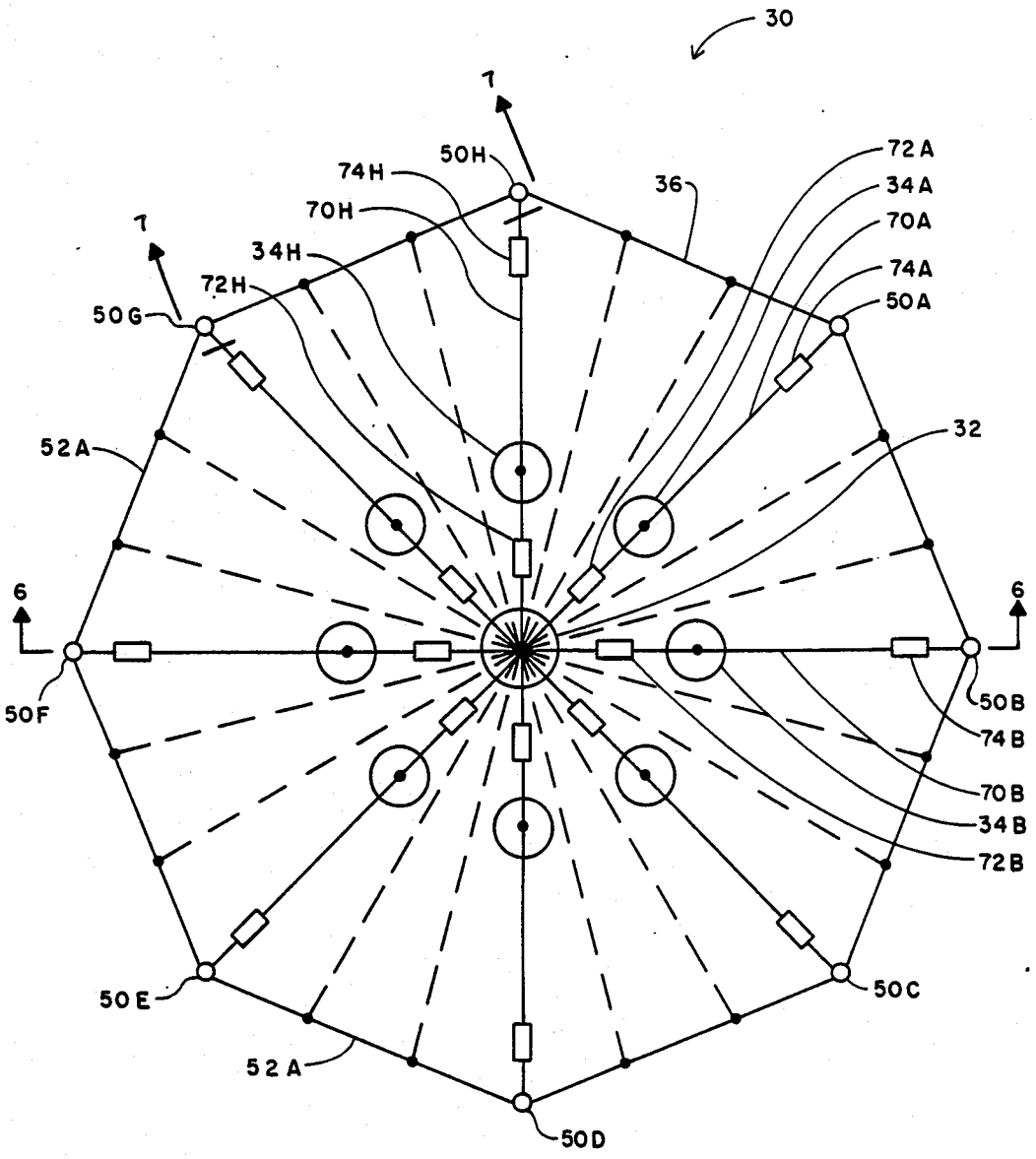
FIG. 5 is a plan view of an antenna system according to an embodiment of the present invention.

FIG. 5 shows an antenna system 30 such as an antenna system employed by an AM broadcasting station. The antenna system 30 of FIG. 5 comprises a vertically erect primarily radiating means such as antenna 32; a plurality of vertically erect secondary radiating means such as secondary radiating antennae 34 disposed in a pattern about the primary antenna 32; and, an electrically conductive screen means such as screen 36 which surrounds the pattern of second radiating antennae 34.

The primary radiating antenna 32 is electrically connected to a primary signal source 40 whereby a signal current having a carrier frequency characterized by the wavelength lambda is applied to the primary antenna 32. In the embodiment shown in FIGS. 5 and 6 the primary radiating antenna 32 is top-loaded by connecting a top portion of a segmented guywire 42 to the top of the primary antenna 32. It is understood to those skilled in the art, however, that other techniques of feeding the primary antenna 32 can be used, so long as the effective current loop for this center radiator comprising the primary antenna is above the surface of the earth to obtain good operating characteristics. The primary antenna 32 has a height on the order of approximately ($\frac{1}{4}$) to ($\frac{3}{8}$) of lambda.

FIG. 5 shows eight secondary radiating antennae 34A through 34H disposed in a circular pattern about the primary antenna 32. Each of the secondary radiating antenna 34 have a height on the order of about (1/36) of lambda and are distanced from the primary antenna 32 and hence the center of the antenna system by a distance on the order of approximately (1/40) of lambda.

At least one of the secondary antennae 34 is connected to a secondary signal source 48 whereby the connected secondary antenna 34 is base-fed or shunt-fed a signal current having the carrier frequency which is the same as that applied to the primary antenna 32. Other ones of the secondary antennae 34A through 34H can also be driven, but in accordance with the above-described geometry the proximity of the secondary antennae 34 to one another results in a mutual coupling whereby all secondary antennae are similarly excited.

The electrically conductive central screen 36 comprises a plurality of vertically erect support poles such as poles 50A through 50H; a plurality of electrically conductive cables 52A through 52E supported by adjacent ones of the poles 50; and, a series of radially extending, partially-buried, partially-exposed electrical conductors 54.

Figure 6:
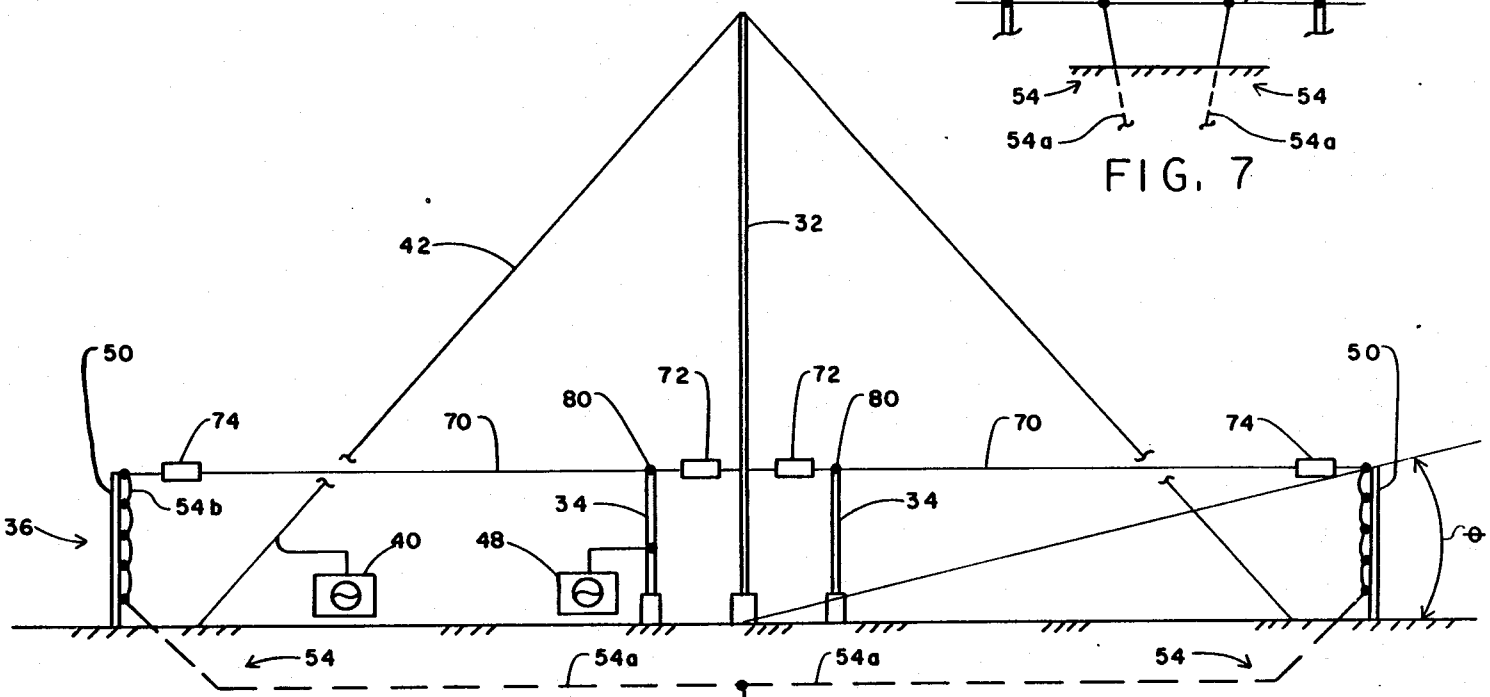
FIG. 6 is a side view of the antenna system of FIG. 5 taken along the line 6—6.

The vertically erect support poles 50A through 50H are arranged in an essentially circular pattern. Although the embodiment of FIGS. 5 and 6 shows a number of support poles 50 equal to the number of secondary antennae 34, it should be understood that more support poles 50 can be used in order to provide proper tension for the cable 52. In the illustrated embodiment the height of each of support pole 50 is about (1/36) of lambda whereby the interior angle theta shown in FIG. 6 is on the order of about 6°.

Figure 7:
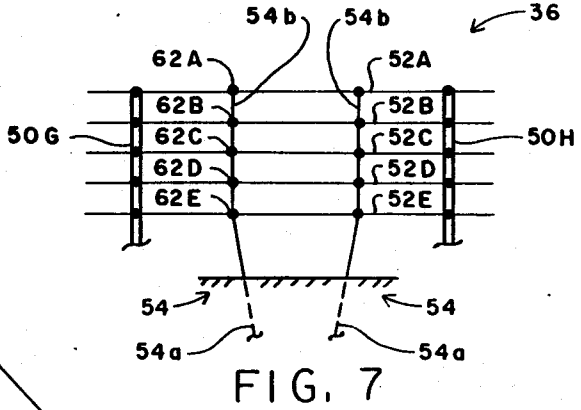
FIG. 7 is a side view of a portion of the antenna system of FIG. 5 taken along the line 7—7; and, FIG. 8 is a schematic diagram showing radiation characteristics associated with the operation of an antenna system according to an embodiment of the invention.

The electrically conductive cables 52 each form an essentially closed loop in an essentially horizontal plane. As seen in FIG. 7, cable 52A forms a horizontal planar loop about the perimeter of the antenna system at a height approximating the height of the poles 50; cable 52B forms a second planar loop about the perimeter of the system at a height slightly shorter than the height of poles 50; and so forth. The cables 52 are spaced apart to form a pattern such as parallel lines, in a vertical plane, as shown in FIG. 7. The electrically conductive cables 52 are, in the illustrated embodiment, cables of the type commonly known as messenger cables.

The series of radially extending conductors 54 comprise a plurality of buried copper conductors which, in like manner as conventional industry practice, each have first ends 54*a* connected together at a point 60 in the center of the system. The first ends 54*a* of the electric conductors 54 are buried at a distance of a few inches below the surface of the earth. Although only 16 such conductors 54 shown in FIG. 5 for the sake of simplification of illustration, it is understood that a considerably greater number of such conductors, for example a number on the order of 120, is provided. Each conductor has a buried segment thereof which is approximately ($\frac{1}{4}$) of lambda in length.

Unlike current practice, the second ends 54*b* of the conductors 54R are, rather than being buried, directed upwardly through the surface of the earth for attachment to the screen 36. In this regard, the second end 54*b* of each conductor 54 is attached to one or more cables 52. In the embodiment shown in FIG. 7, the second ends 54*b* of the conductors 54 are electrically connected to the cables 52 at points lying in a vertical plane which can be seen as extending perpendicularly to the plane of the sheet of FIG. 7. Thus, with respect to the FIG. 7 embodiment, each conductor 54 has a second end 54*b* connected to the five cables 52A through 52E at respective connection points 62A through 62E.

In view of the foregoing, it is seen that while the first ends 54*a* of the conductors 54 are essentially horizontally disposed beneath the surface of the earth, the second ends 54*b* of the conductors 54 assume an essentially vertical orientation whereby, considering the symmetry of the system, a saucer or bowl-shaped network is formed. Furthermore, as seen in FIG. 7, the electrical connections of the cables 52 and conductors 54 gives the screen 36 a mesh or grid-like appearance as seen from the side. It should be understood that the screen 36 may be made more or less fine by changing the number of cables 52 and the number of conductors 54 utilized in construction of a screen.

The electrically conductive screen 36 is not connected to a drive source but instead has induced thereon an image of the electromagnetic field incident thereon.

The antenna system 30 of the embodiment of FIGS. 5 and 6 also comprises a plurality of open-ended, open-wire transmission lines 70 which are suspended at a height of about (1/36) of lambda above the ground. Eight such transmission lines 70A through 70H corresponding to the number of screen poles 50 and secondary antennae 34 are shown in FIG. 6, but it should be understood that a greater or lesser number of transmission lines 70 may be employed. In this regard, for tensioning purposes a first end of each transmission line 70 is connected through an insulator 72 to the primary antenna 32 and a second end of each transmission line 70 is connected through an insulator 74 to an associated support pole 50 comprising the screen 36. Each transmission line 70 is associated with one of the secondary antennae 34 and has a top of the associated secondary antennae 34 electrically connected thereto as shown at points 80, for example. Thus, for each secondary antenna 34, the associated transmission line 70 enables the input impedance as viewed from the top of the antenna 34 to be approximately zero ohms.

A conventional broadcasting antenna, such as an antenna employed by an AM radio station, can be adapted for operation in accordance with the present invention. A conventional antenna system generally has a primary antenna and a plurality (generally 120) of buried copper conductors. For adaptation, a plurality of secondary antennae (such as antennae 34 described above) are erected, each secondary antenna 34 being distanced about (1/40) of lambda from the primary antenna. An essentially circular ditch is dug to expose the furthest ends of the buried copper conductors. At a radial distance from the primary antenna which is just greater than the radial location of the ditch, a plurality of screen posts (such as support posts 50 as described above) are erected. A plurality of electrically conducting cables (such as messenger cables 52) are connected to the support posts 50 in order to perform a plurality of essentially horizontal planar loops or to provide a mesh or grid on the fence as seen in the vertical plane. The exposed ends of each of the copper conductors lying in the ditch are located. A first end of another or supplemental segment of copper conductor is connected to the exposed end of the buried conductor and oriented toward the screen. A second end of this supplemental segment of copper conductor is electrically connected to the electrically conductive cable nearest the top of the screen, with intermediate electrical connections being made at lower heights to other cables forming the screen. The secondary antennae are then connected to a secondary signal source in a manner whereby the secondary antennae radiate to cancel the sky-ward radiation radiated by the primary antenna and whereby, having taken into consideration the geometric and operative parameters of the system, the secondary antenna ground wave radiation is effectively curtailed by the screen.

Figure 8:
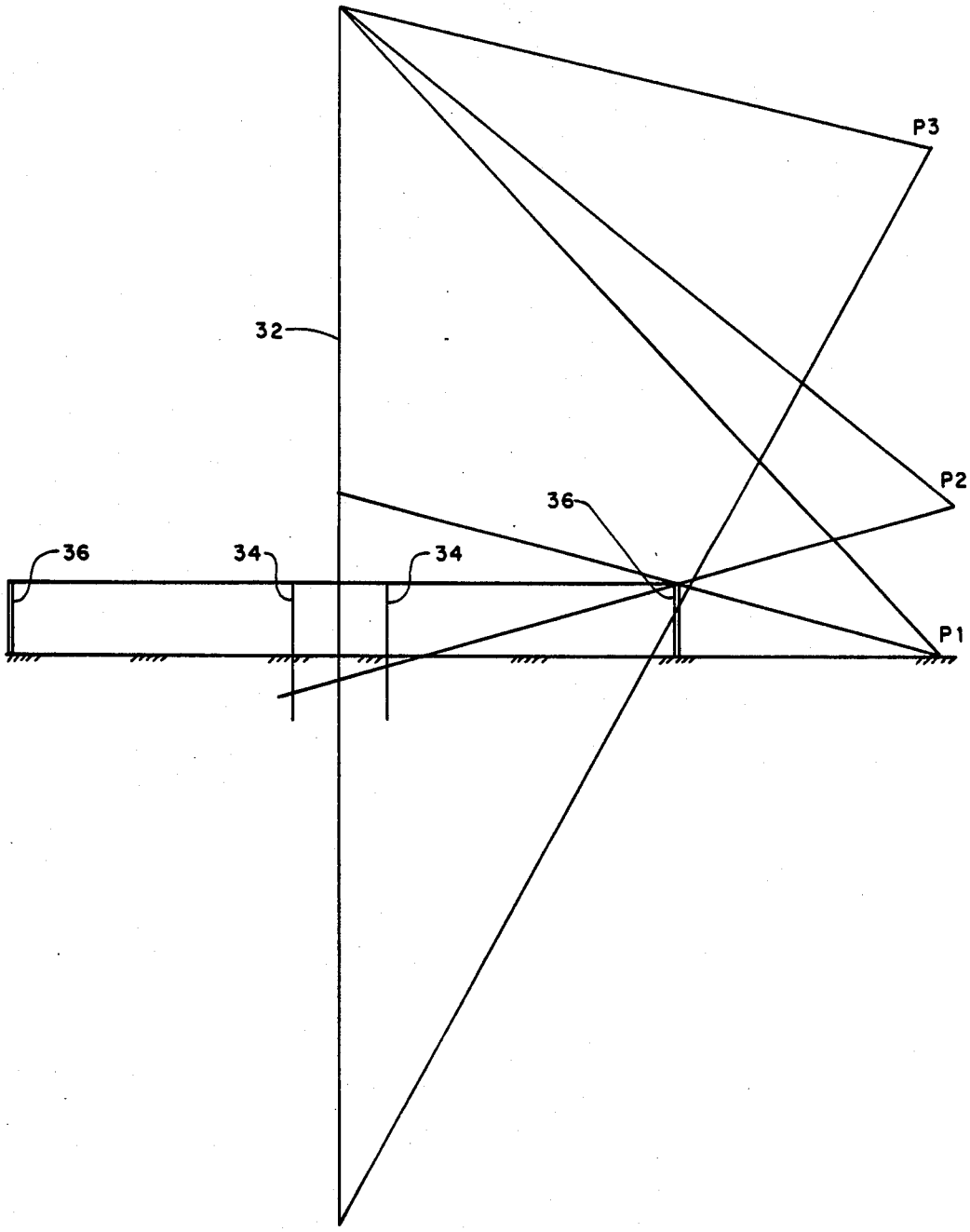

At a far-field observation point on the earth's surface, such as point $P_1$ as shown in FIG. 8, the electric screen 36 acts to prevent the collection of secondary antennae 34 from illuminating the surface of the earth and thereby generating a surface wave. At appreciable angles above the horizon, however, the geometry of the structure permits more and more of the current carrying length of the secondary antennae 34 to become effective in radiating a sky-ward field, for example at points P2 and P3 in FIG. 8.

Figure 4:
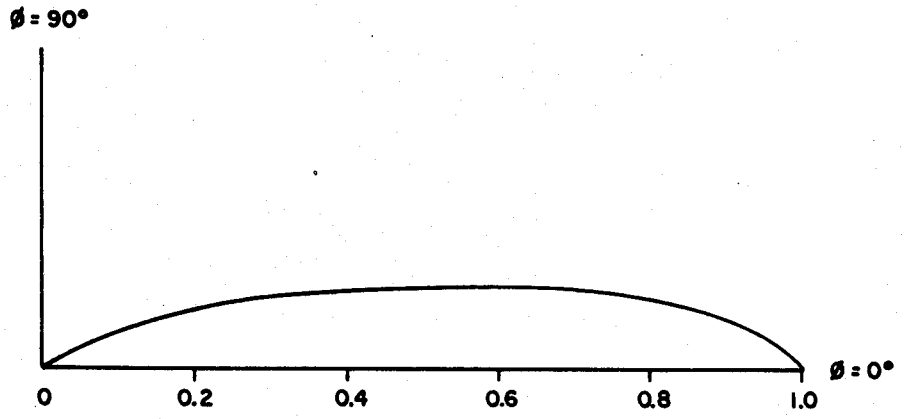
FIG. 4 is a graph showing the relative magnitude of a surface wave field as a function of a vertical angle phi as generated by an antenna system according to an embodiment of the invention.

The number and placement of the secondary antennae 34 together with their height and the height and radius of the circular electric screen 36 is designed as to provide a very close match in both amplitude and phase to the sky-ward radiation from the taller primary antenna 32. By appropriate adjustment of the phase and magnitude of the currents flowing in the secondary antennae 34, this sky-ward radiation can be made to very nearly cancel the sky-ward radiation of the taller primary antenna 32 over wide ranges of vertical angles. Since the screen 36 has a drastic effect upon the ability of the secondary antennae 34 to generate a surface wave while only modestly affecting the ground wave characteristics of the taller primary antennae 32, a strong ground wave results, even though the sky-ward radiation is severely curtailed. In this respect, the surface wave has a vertical plane pattern generally similar to that shown in FIG. 4. The precise vertical plane pattern depends upon radiator height (length), current distribution, earth constants, etc.

More than one secondary antennae 34 is used to aid in obtaining the desired radiation pattern (both amplitude and phase) from the short secondary antennae, and to achieve improved electrical efficiency through mutual impedance effects.

This invention results in greatly increased ground wave signal strengths per unit of power fed to the system over that obtained by conventional antenna systems. The fields so generated are on the order of twice those usually obtained in practice, but precise values are greatly influenced by frequency, antenna design, and the electrical characteristics of the earth.

While the invention has been particularly shown and described with reference to the preferred embodiments thereof, it will be understood by those skilled in the art that various alterations in form and detail may be made therein without departing from the spirit and scope of the invention. For example, the primary antenna 32 and/or the secondary antennae 34 can be "stagger tuned" in accordance with conventional prior art practices.

The embodiments of the invention in which an exclusive property or privilege is claimed are defined as follows:

1. A radiating antenna system comprising:
vertically erect primary radiating means;
means connected to said primary radiating means for driving said primary radiating means;
a plurality of vertically erect secondary radiating means disposed in a pattern about said primary radiating means;
electrically conductive screening means surrounding said pattern of secondary radiating means for curtailing at least the propagation of surface waves radiated by said secondary radiating means; and,
means connected to at least one of said secondary radiating means for driving said secondary radiating means in a manner whereby radiation from said secondary radiating means essentially curtails sky-wave radiation components radiated by said primary radiating means.

2. The apparatus of claim 1, wherein lambda is the wavelength of the radiating frequency of the primary radiating means, wherein said primary radiating means has an erect height on the order of about ($\frac{1}{4}$) of lambda; and wherein said secondary radiating means have an erect height on the order of about (1/36) of lambda.

3. The apparatus of claim 1, wherein lambda is the wavelength of the radiating frequency of the primary radiating means, and wherein said secondary radiating means are each distanced from said primary radiating means by a distance on the order of about (1/40) of lambda.

4. The apparatus of claim 1, wherein lambda is the wavelength of the radiating frequency of the primary radiating means, and wherein said screening means is distanced from said primary radiating means by a distance on the order of about ($\frac{1}{4}$) of lambda.

5. The apparatus of claim 1, wherein said secondary radiating means and said screening means have essentially the same vertical height.

6. The apparatus of claim 1, wherein said screening means further comprises:
a plurality of vertically erect support means disposed in a pattern about said pattern of secondary radiating means;
at least one electrically conductive cable supported by adjacent ones of said vertically erect support means in a manner whereby said electrically conductive cable forms an essentially closed loop in an essentially horizontal plane; and,
a series of electrical conductor means, a first end of each of said conductor means in said series being buried beneath the surface of the earth proximate said primary radiating means and a second end of each of said conductor means in said series being electrically connected above the surface of the earth to said electrically conductive cable.

7. The apparatus of claim 6, wherein said first ends of said electrical conductor means in said first series are connected to one another proximate said primary radiating means.

8. The apparatus of claim 6, wherein said screening means comprises a plurality of electrically conductive cables, said cables being spaced apart from one another to form a pattern, and wherein each of said conductor means in said series has its second end connected to a plurality of said electrically conductive cables in a manner to form a meshed grid.

9. The apparatus of claim 8, wherein said electrically conductive cables form loops lying in essentially parallel horizontal planes.

10. The apparatus of claim 1, further comprising:

a series of open-ended transmission lines, said open-ended transmission lines in said series being arranged in a pattern about said primary radiating means whereby a first end of each of said transmission lines in said second series is proximate but electrically insulated from said primary radiation means and a second end of each of said transmission lines in said series is proximate but electrically insulated from said screening means, each of said transmission lines in said series being held above the earth's surface at a height substantially equal to the vertical height of said secondary radiating means.

11. The apparatus of claim 10, wherein each of said open-ended transmission lines in said series is connected to an associated secondary radiating means.

12. The apparatus of claim 1, wherein said screening means is sufficiently distanced from said primary radiating means whereby an interior vertical angle subtended by a ray from the base of said primary radiating means to the top of said screen and a ray extending from the base of said primary radiating means in a horizontal ground plane.

13. The apparatus of claim 1, wherein said screening means is electrically conductive by the inducement thereon of an image of an incident electromagnetic field.

14. A method of curtailing the propagation of sky waves from a primary radiating antenna, said method comprising the steps of:

erecting a plurality of secondary radiating antennae in a pattern about said primary radiating antenna;

erecting electrically conductive screening means in a manner whereby said screening means surrounds said pattern of secondary radiating antennae and has a vertical height approximating the height of said secondary radiating antenna;

driving said secondary radiating antennae in a manner whereby radiation from said secondary radiating antennae essentially curtails sky wave radiation components radiated by said primary radiating antenna; and, using said screening means to curtail at least the propagation of surface wave radiation components radiated by said secondary radiating antennae.

15. A radiating antenna system comprising:

vertically erect primary radiating means;

means connected to said primary radiating means for driving said primary radiating means;

a plurality of vertically erect secondary radiating means disposed in a pattern about said primary radiating means;

a series of open-ended transmission lines arranged in a radially extending pattern from the vicinity of said primary radiating means, each of said open-ended transmission lines being suspended in an essentially horizontal plane above the surface of the earth and being electrically connected to a top end of an associated one of said plurality of secondary radiating means;

means for suspending said transmission lines in said essentially horizontal plane; and, means connected to at least one of said secondary radiating means for driving said secondary radiating means in a manner whereby radiation from said secondary radiating means essentially curtails sky wave radiation components radiated by said primary radiating means.

* * * * *